United States Patent [19]

Bender

[11] Patent Number: 5,067,894

[45] Date of Patent: Nov. 26, 1991

[54] OIL BURNER ASSEMBLY

[75] Inventor: Glenn Bender, Princeton, Mo.

[73] Assignee: Shenandoah Manufacturing Co., Inc., Harrisonburg, Va.

[21] Appl. No.: 433,230

[22] Filed: Nov. 8, 1989

[51] Int. Cl.[5] ..... F23D 11/44

[52] U.S. Cl. ..... 431/208; 431/36; 431/37

[58] Field of Search ..... 431/11, 154, 208, 259, 431/258, 36, 37, 41

[56] References Cited

U.S. PATENT DOCUMENTS

| | | | |
|---|---|---|---|
| 2,726,715 | 12/1955 | Tegtmeyer | 431/208 |
| 3,090,420 | 5/1963 | Sacco | 431/208 X |
| 4,047,880 | 9/1977 | Caldanelli | 431/259 X |
| 4,392,810 | 7/1983 | Beans et al. | 431/208 X |
| 4,487,571 | 12/1984 | Robertson et al. | 431/208 |
| 4,827,898 | 5/1989 | Liao et al. | 431/208 X |

FOREIGN PATENT DOCUMENTS

| | | | |
|---|---|---|---|
| 506352 | 10/1951 | Belgium | 431/208 |
| 2091870 | 8/1982 | United Kingdom | 431/208 |

*Primary Examiner*—Carl D. Price

*Attorney, Agent, or Firm*—Mason, Fenwick & Lawrence

[57] ABSTRACT

There is disclosed a waste oil burner having a quick connect and disconnect subassembly. The subassembly includes a housing and an elongated horizontally disposed elongated metal block extending therefrom and terminating in a nozzle for carrying outwardly waste oil and air. The block describes a tortuous path for waste oil which is subjected to being heated in view of the presence of an electric heater in the block. The block also has a bore for the introduction and carrying out compressed air. Suitable air and waste oil connections are supplied approximate the rear end portion of the block. Electric plug in connection is provided whereby electrical contact is made with electric outlet means associated with said oil burner main assembly.

6 Claims, 6 Drawing Sheets

OIL BURNER ASSEMBLY

BACKGROUND OF THE INVENTION

It will be appreciated that considerable waste oil is generated as a result of the waste oil garnered from the crankcases of millions of automobiles and trucks whenever the oil is changed. While the frequency rate for changing the oil has gone down over the last few years, nevertheless much discarded oil is still obtained. The disposal of the vast quantities of to-be-discarded oil constitutes a great problem. The problem is exacerbated by the fact with longer periods ensuing between oil changes of the to-be-changed oil contains greater deleterious constituents.

Some of the waste oil is cleaned and is then re-sold for use in automobiles and trucks but most of the waste oil defies purification so must be either dumped in appropriate disposal cites or must be burned.

Burning of waste oil presents its own hazards if not properly and completely combusted. Therefore, any waste oil burner must ensure proper viscosity of the waste oil just prior to atomization. Also a sufficient supply of air must be constantly available to insure complete combustion. Therefore any waste oil burner must possess means for adjustment of parameters such as control of the amount to be burned, the temperature of the waste oil to control viscosity, the amount of air available both for entrainment of the waste oil as it is sprayed from a nozzle and additional air for the ambient.

Finally, the oil burner should be amenable to quick repairs or parts replacement in view of the fact that the waste oil will clog nozzles and the like.

PRIOR ART

The concept of providing heat to both the liquid fuel and the air for combustion can be seen in a number of patents. Most germane is the patent to Reicheln U.S. Pat. No. 3,361,183. The patentee discloses a singular block which may be electrically heated. A tortuous path is provided for the air for combustion and for a portion of the combusting fuel gases which portions is returned to the distribution nozzle. The device of Reichheln falls short of the present device in that a portion of the fuel is combusted in the device itself while in the instant device no fuel is acutally combusted in heat exhcange block thereby in the latter much better control is effectuated. Furthermore, the instant subassembly disclosed can be easily efficiently connected and disconnected.

SUMMARY OF THE INVENTION

There is disclosed a waste oil gun type burner having a quick connect and disconnect subassembly. The subassembly includes a housing and an elongated horizontally disposed elongated metal block extending therefrom and terminating in a nozzle for carrying outwardly atomized waste oil and air. The block describes a tortuous path for waste oil which is subjected to being heated in view of the presence of an electric heater in the block. The block also has a channel for the introduction and carrying of compressed air. Suitable air and waste oil connections are supplied approximate the rear end portion of the block. Electric plug in connection is provided whereby electrical contact is made with electric outlet means associated with said oil burner main assembly.

DETAILED DESCRIPTION OF THE DRAWINGS

Figure 1:
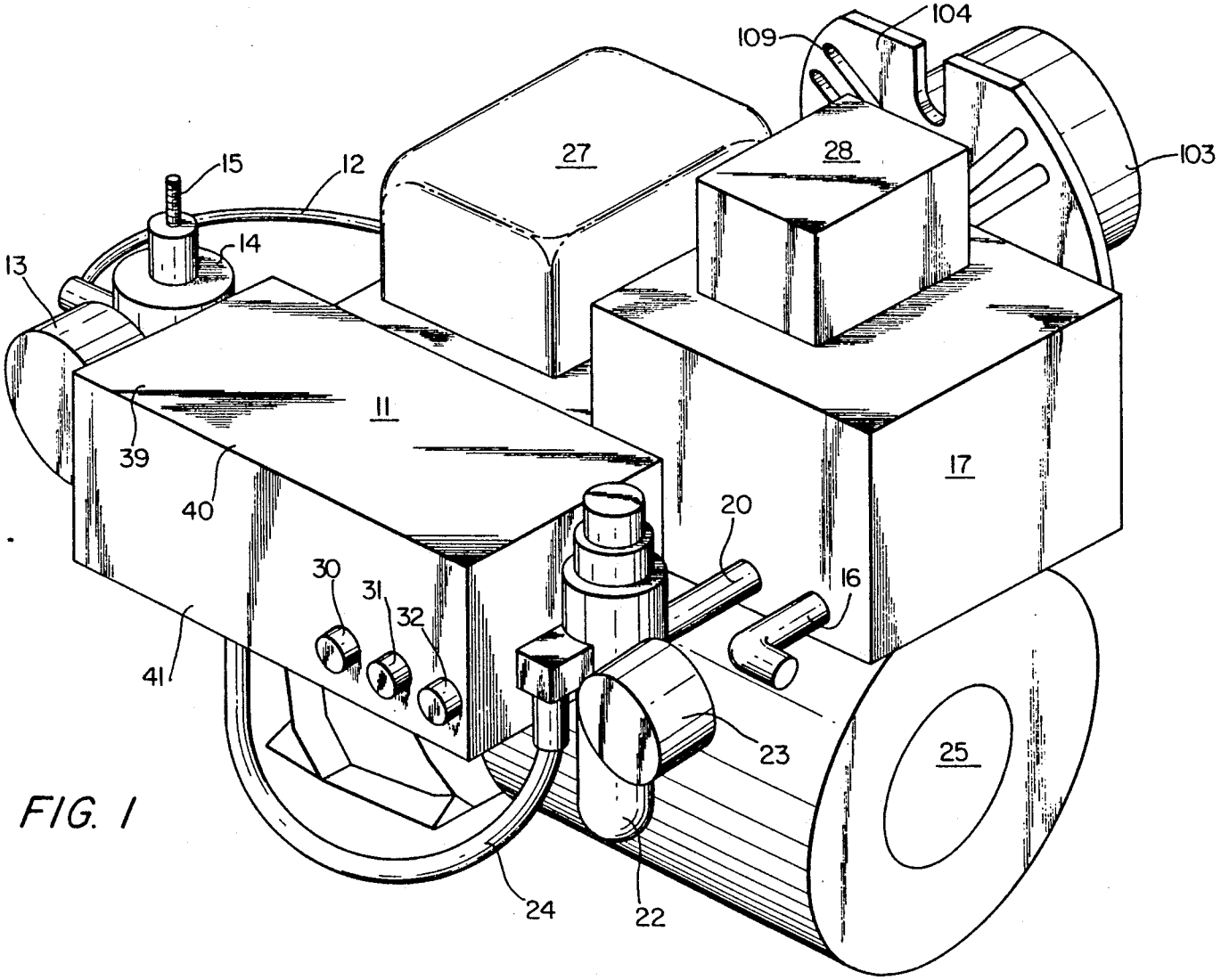
FIG. 1 is a perspective view of the waste oil burner of the present invention.

The burner of the present invention can be seen, generally, from FIG. 1. At the rear of the burner is a quick removal control housing 11 which carries an ingeniously constructed elongated aluminum electrically heated block designed to provide a tortuous path for to-be-burned waste oil, more about which will be noted hereinafter.

The oil is introduced under pressure through conduit 12 which is permitted to pass through pressure gauge 13 and which may be controlled by a pressure regulator 14 through screw 15.

Figure 2:
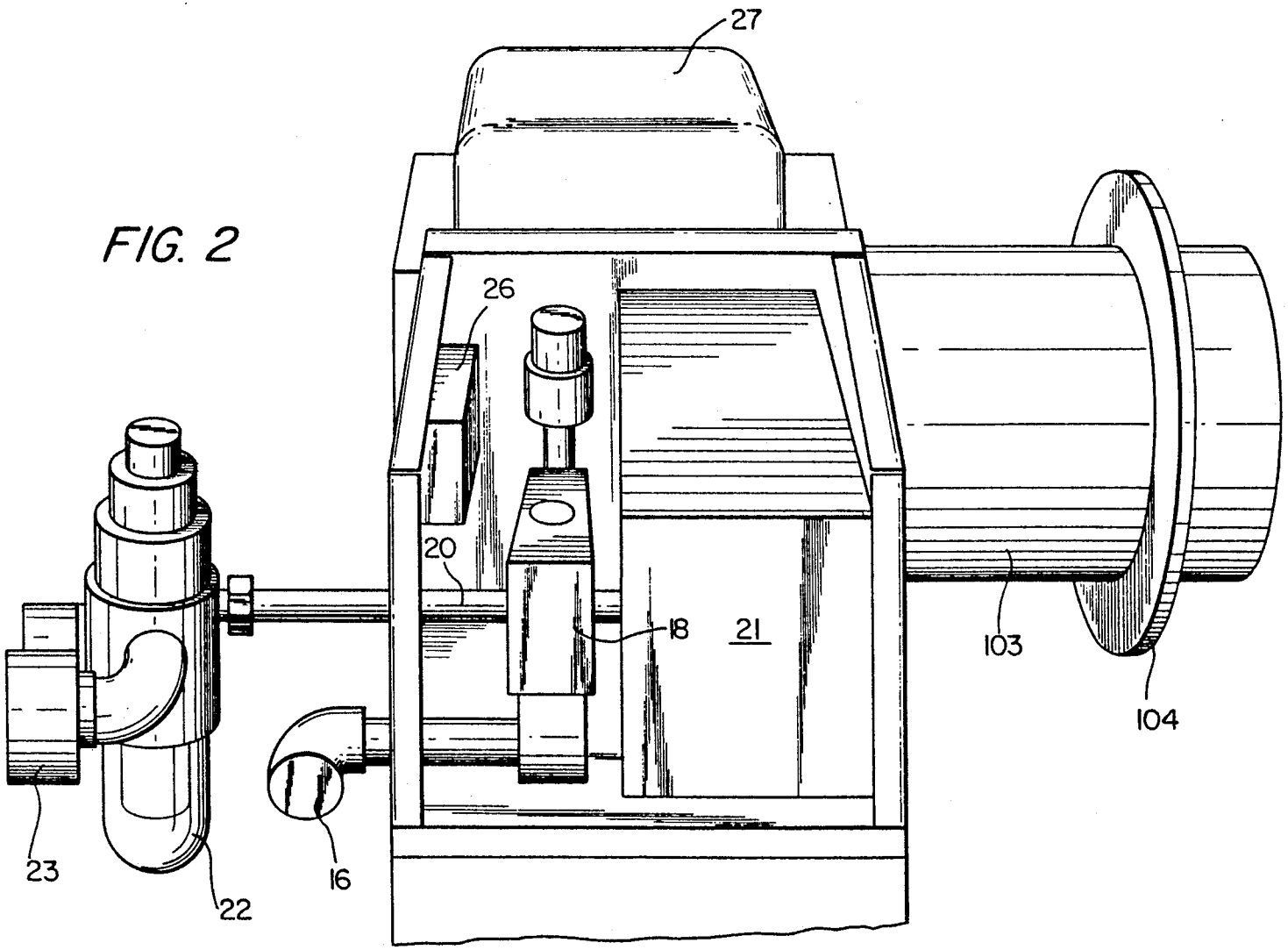
FIG. 2 is a fragmentary side view of the burner with the cover over the controls removed.

The system is also supplied with compressed air through a introductory air conduit 16. The air conduit 16 enters housing 17, the inside of which can be seen in FIG. 2 which is shown with the cover in a removed condition. Conduit 16 extends horizontally and then makes a turn through solenoid valve 18 and then terminates in a T-connection with conduit 20. In one direction the conduit terminates in an air accumulator 21. In the other direction it terminates with an air filter 22 and pressure regulator. A pressure gauge 23 is operatively connected to the air filter 22. There is a further conduit 24 which conveys the compressed air in the direction of a relatively quick disconnect oil and air heater mentioned in the foregoing.

Housing 17 is located above electric motor 25 which drives both an air turbine 108 (see FIG. 6) for the oil burner and an oil pump 110 (see FIG. 4) all on the same axle drive.

The quick disconnect means has an extending three prong plug 29 (see FIG. 3) for connection with a female electrical outlet 26 located in housing 17 and extends outwardly therefrom.

Housing 27 on the top of the oil burner contains the high voltage generating means needed to provide the high voltage electricity for the spark igniter 107 located in the space close to the air-oil dispensing nozzle 102 mentioned with greater particularity hereinafter.

Another housing 28 located atop the housing 17 contains a re-set electrical means for controlling the electric components of the burner.

Indicator lights 30,31 and 32 are designed to display the on or off mode for the electric block heater, the fact of air under pressure in the block 101 and the fact of conveyed oil in the block 101.

Figure 6:
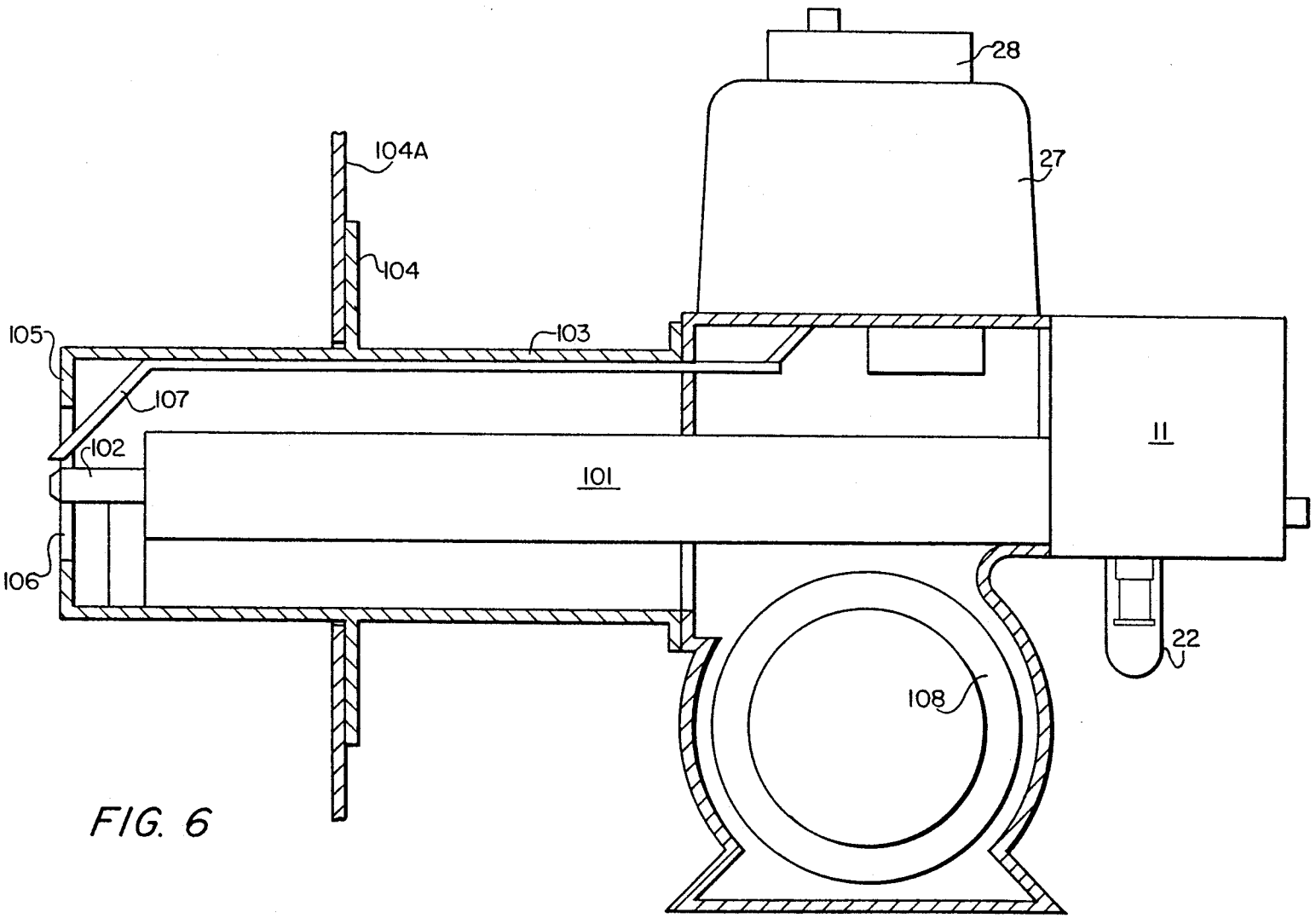
FIG. 6 is a vertical plane cross sectional view of a portion of the burner showing the elongated heat exchange block.

As has been stated heretofore in the foregoing the oil burner of the present invention has as a primary feature the elongated heat exchange block 101, hereinafter referred to as the block. The said block 101 can be seen in FIG. 6 as the rectangularly configured block horizontally disposed terminating in an oil-air delivering nozzle 102. The block 101 extends axially in spaced relationship in tube 103 and has a radially extending flange 104 which has suitable spaced slots 109 through which the oil burner maybe conventionally secured to the combustion chamber wall, a portion of which is shown in FIG. 6 at 104A.

The tube 103 has an end wall 105. The end wall 105 has a relatively large egress opening 106, through which a portion of the nozzle 102 extends. Above the nozzle 102 is a conventional spark lighter 107 to ignite the fuel and air mixture as it is sprayed from the nozzle.

Rearwards of the nozzle 102 is a conventional air turbine 108 designed to provide pressurized air flow to the tube 103 annularly spaced from block 101 and egress opening 106. The turbine 108 is driven in a conventional manner by an electric motor 25, seen in FIG. 4.

Figure 5:
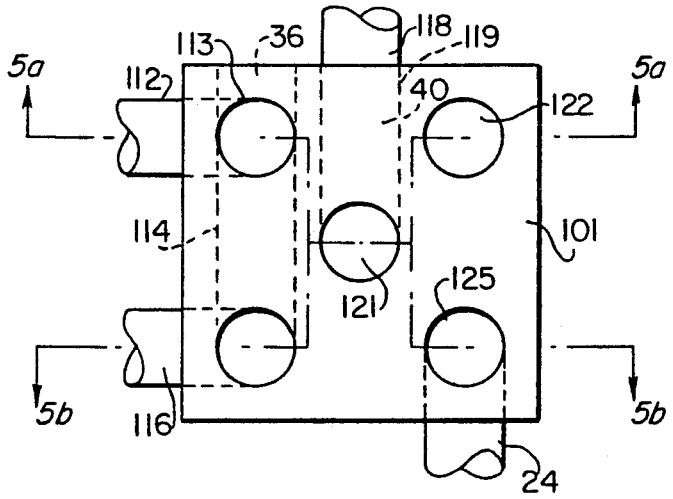
FIG. 5 is an end of the block of the present invention.

Attention is now directed to block 101 which as has been stated has an elongated rectangular configuration. It has a plurality of longitudinal bores therein. For an excellent view thereof attention is directed to FIGS. 5, 5*a* and 5*b*. FIG. 5 is a rear end view of the block 101 showing the various openings by means of which the block 101 has been drilled. For clarity of view the conduits are not obscured by the various electrical connections and the like.

Therefore conduit 112 carries oil under pressure into bore 113 which flows longitudinally of the block 101 to vertical bore 114, and returns by way of bore 115 and exits out conduit 116 for operative connection to a electric solenoid valve 117. From electric solenoid valve 117 the oil returns to the block 101 through conduit 118 and enters vertical bore 119 and thence forwardly through longitudinal bore 121 for egress through nozzle 102, previously discussed.

Longitudinal bore 122 is designed to house an elongated electric heater 120 which is connected to a source of electricity by electric lines 123.

Another vertical bore 124 is provided whereby to introduce compressed air into the block 101. The vertical bore 124 is operatively connected to longitudinal elongated bore 125 which extends through block 101 and exits at an angle conduit 126 whereby to feed the supply of air to the oil being introduced into the nozzle and entrains the oil. Bore 125 has a somewhat larger diameter than the other horizontal bores to thereby provided an ample supply of air.

Suitably disposed plugs 34, 35 are provided at the ends of the block 101 to close the bores after the drilling operations have been completed.

The block 101 is preferably constructed of aluminum so that it is highly heat conductive from the elongated area in which the electric heater 120 is located.

As a primary feature of the present invention is the aluminum heater block 101 which is part of the quick disconnect assembly, it is incumbent to detail in particular the block 101 and its various channels. Accordingly, attention is again directed to FIGS. 5, 5*a* and 5*b*.

Note that FIG. 5 is an end view of block 101, shown without the respective end plugs which are necessary due to the fact that the elongated bores are drilled from the end as shown in FIG. 5 and are then plugged as required.

Figure 5A:
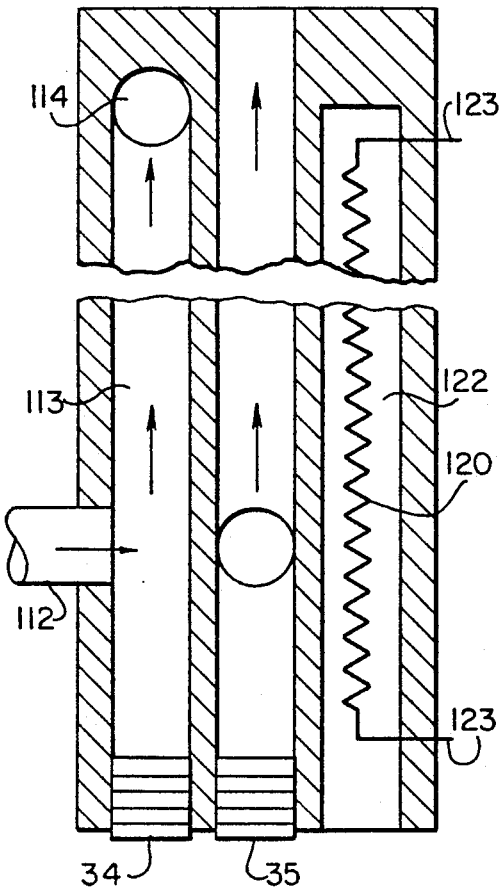
FIG. 5*a* is a cross sectional view in a horizontal plane of the elongated heat exchange block in the direction of 5*a*—5*a*.
Figure 5B:
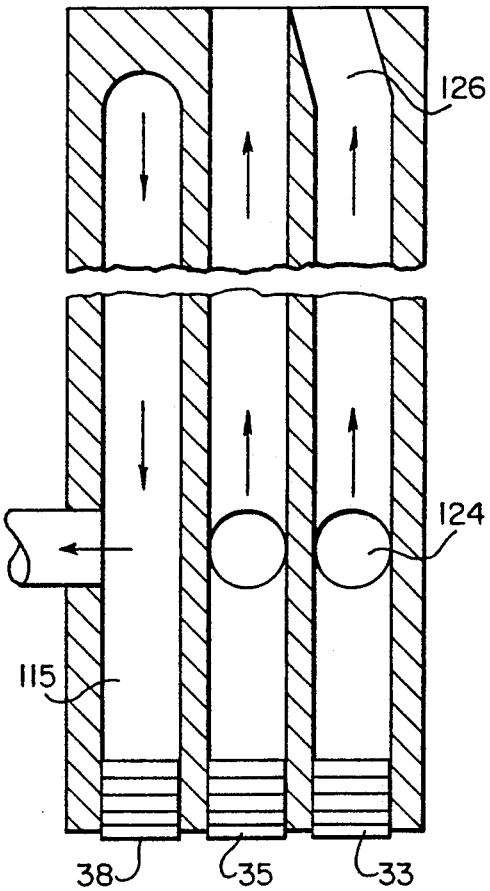
FIG. 5*b* is a cross sectional view in a horizontal plane of the elongated heat exchange block in the direction of 5*b*—5*b*.

FIG. 5*a* is to a horizontal fragmentary cross-section taken along line 5*a*—5*a*, i.e. upwardly. Note that the oil enters conduit 112 in the direction of the arrows. In FIG. 5*a* it will be seen that plugs 34 and 35 close off the bores 113 and 121, respectively. As stated the oil moves to downwardly extending bore 114 which is shown by dotted lines. Bore 114 has been vertically bored into block 101 from the top and is closed by plug 36 also shown by dotted lines. The vertical bore 114 operatively connects to horizontal bore 113 with horizontal bore 115 located immediately therebelow. The oil then continues its flow now rearwardly and exits through oil conduit 37. Bore 115 has an end plug 38.

The somewhat heated oil is directed through electric solenoid valve 117 and there-out of through conduit 118 for re-introduction into the top of block 101 for another pass through the said block 101 through horizontal bore 121. The oil enters and is directed downwardly through relatively short bore 119 from whence it is distributed forwardly through bore 121 onto which the nozzle 102 is attached.

It will be appreciated from the foregoing that the oil makes three horizontal passes through the block 101 thereby insuring maximum heating contact with the block 101 during the tortuous travel of the waste oil.

Returning to FIG. 5*b*, vertical conduit 124 carries compressed air from conduit 24 an into horizontal bore 125 which has a plug 33. The bore 125 is bored at the forward end at an angle portion 126 whereby the compressed air egresses proximate the oil from bore 121 and is carried forward through the nozzle 102. The oil is under pressure and the air is also under pressure and engages in a turbulent helical distribution at the nozzle 102 whereby the oil is atomized. The so sprayed oil is provided with additional air from the aforementioned air turbine 108 which supplies air longitudinally up tube 103 in the space defined by tube 103 and block 101.

Figure 3:
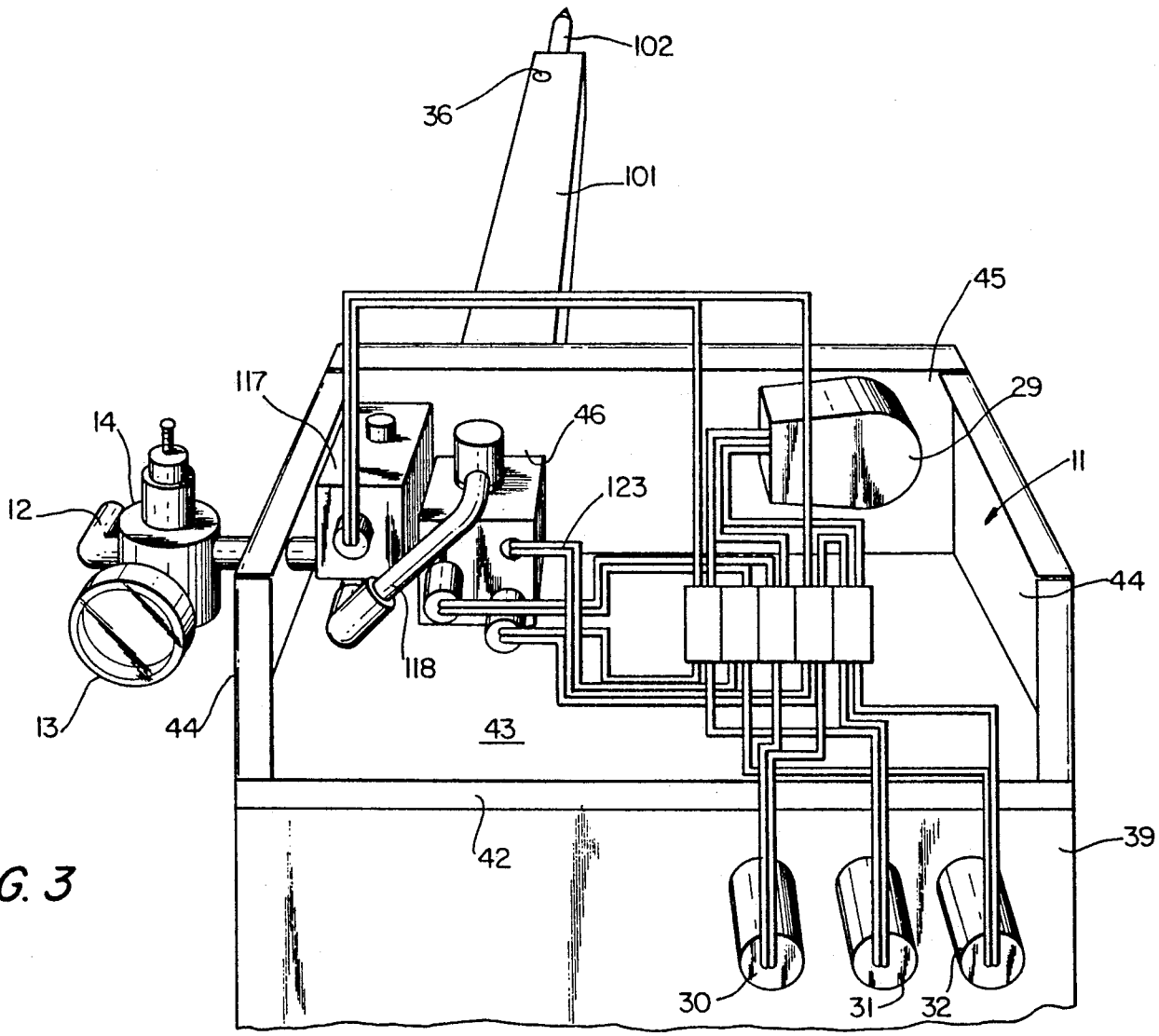
FIG. 3 is a fragmentary end view of the quick disconnect subassembly showing the elongated heat exchange block.

Another important feature of the present invention resides in the quick disconnect subassembly as best shown by FIG. 3 which consists of housing 11 and the block 101. The housing has a cover 39 and when the housing 11 is closed it forms the top of the housing and a rearward facing wall. The cover has a hinge 42. From the view of FIG. 3 the internal portion of the indicator lights 30, 31 and 32 can be seen.

The housing 11 has a floor 43 and side walls 44 and a front wall 45. The rearward extending portion of block 101 extends through a rectangularly shaped opening 46 of front wall 45.

The block carrying subassembly may be easily disconnected from the remainder of the burner whenever the subassembly is no longer functioning properly and may be replaced by another identical unit. The need for quick removal is necessary when for instance nozzle 102 clogs and must be replaced. Front wall 45 has at least one suitably positioned screw hole for connection and disconnection from the burner main assembly. The oil and air conduits may be easily disconnected and connected by conventional fluid conduit couplings. The electric lines all terminate in mentioned male plug 29 which electrically couples with mentioned conventional female outlet 26 carried by the main burner assembly. Furthermore as a matter of fact the male plug and female outlet may be reversed, as found convenient.

Figure 4:
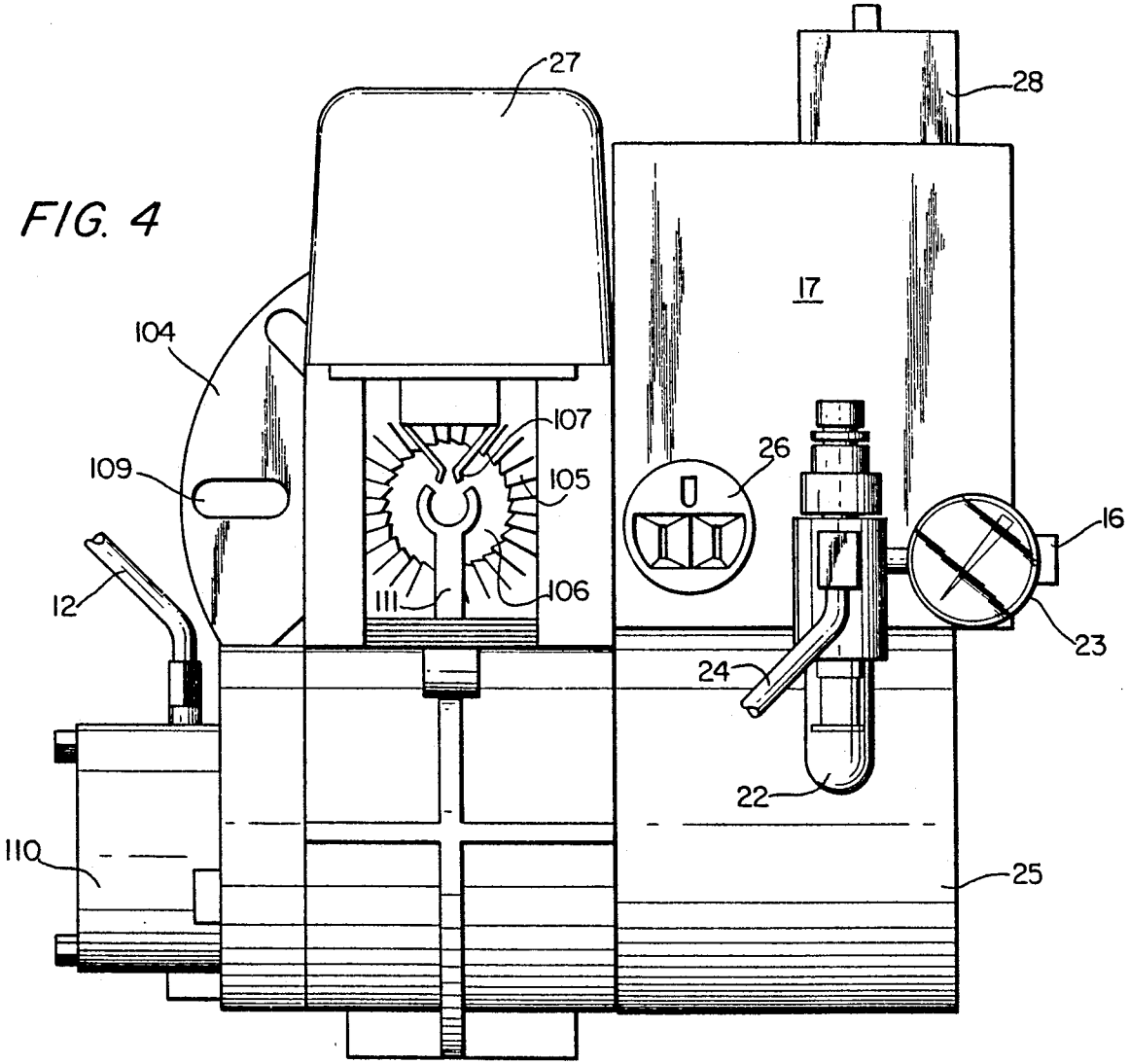
FIG. 4 is the back of the burner with the quick disconnect subassembly removed.

FIG. 4 depicts essentially the back portion of the main burner assembly showing that the quick disconnect subassembly has been removed. It will be noted that a view of the inside of tube 103 can thereby be afforded. Note that wall 105 surrounding large opening 106 has fins for directing air flow. Also note upright 111, which is constructed to cradle and support the block 101 by supporting the nozzle 102.

What is claimed is:

1. An oil burner assembly for burning waste oil fuel, comprising a waste oil burner subassembly including an elongated preheating block portion and a generally box-shaped control housing portion secured thereto, means for removably mounting said burner subassembly on a combustion chamber wall with the preheating block portion protruding through said wall and the control housing portion disposed outwardly adjacent the wall, the preheating block being an elongated metal block of rectangular cross-section having a rearward end portion and a front end portion, an air/waste oil burner nozzle carried by said front end portion, said elongated block having first and second longitudinally elongated bores extending in transversely spaced parallelism throughout their length substantially coextensively along their entire length, first conduit means in said rearward end portion for conducting waste oil fuel to the first bore, a transverse connecting bore interconnecting the first and second bores at said front end portion whereby waste oil fuel supplied to said first bore passes forwardly through the length thereof and returns along the length of said second bore to said rearward end portion, second conduit means including an exit bore portion communicating said second bore at said rearward end portion to a solenoid valve in said control housing for conducting the waste oil fuel from the rearward end portion of the second bore to said solenoid valve and including a return conduit portion for returning the waste oil fuel to said block adjacent said rearward end, third, fourth and fifth longitudinal bores in said block paralleling said first and second bores and spanning the length of the block in transversely spaced parallelism with each other throughout their length, connecting bore means communicating said return conduit portion to said third bore, the third bore terminating in a first opening in said front end portion, an elongated electric heater in said fourth bore for heating said block, air conduit means coupled to said fifth bore at the rearward end portion of said block, said fifth bore terminating in a second opening in said front end portion, and said nozzle having means for providing fluid communication with both said first and second openings.

2. The subassembly for an oil burner according to claim 1 wherein said elongated metal block is aluminum.

3. The subassembly for an oil burner according to claim 1 wherein said housing has a rigid electric plug means whereby it is directly electrically connectable to electric outlet means mounted on said oil burner.

4. The subassembly for an oil burner according to claim 3 wherein said elongated metal block is aluminum.

5. The subassembly for an oil burner according to claim 1 wherein said housing has a cover which comprises a top and a rearwardly facing rear wall, said housing having a front facing wall, said rear portion of said elongated metal block extends through said front facing wall.

6. The subassembly for an oil burner according to claim 5 wherein said housing has a rigid electric plug means whereby it is directly connectable to electric outlet means mounted on said oil burner.

* * * * *